US011407555B2

(12) United States Patent
He et al.

(10) Patent No.: US 11,407,555 B2
(45) Date of Patent: Aug. 9, 2022

(54) FLATTENING-REALIZABLE FILE RACK AND ASSEMBLING METHOD THEREOF

(71) Applicant: Dongguan Jiayaoxing Packaging Products Co., Ltd., Guangdong Province (CN)

(72) Inventors: Yaolong He, Guangdong Province (CN); Jun Tang, Guangdong Province (CN)

(73) Assignee: DONGGUAN JIAYAOXING PACKING PRODUCTS CO., LTD., Guangdong Province (CN)

( * ) Notice: Subject to any disclaimer, the term of this patent is extended or adjusted under 35 U.S.C. 154(b) by 0 days.

(21) Appl. No.: 17/027,833

(22) Filed: Sep. 22, 2020

(65) Prior Publication Data

US 2022/0053929 A1 Feb. 24, 2022

(30) Foreign Application Priority Data

Aug. 18, 2020 (CN) ..... 202010833275.9

(51) Int. Cl.
*B65D 5/56* (2006.01)
*B65D 5/02* (2006.01)
*B42F 7/14* (2006.01)

(52) U.S. Cl.
CPC ..... *B65D 5/566* (2013.01); *B42F 7/145* (2013.01); *B65D 5/0254* (2013.01); *B65D 5/0281* (2013.01)

(58) Field of Classification Search
CPC . B65D 5/566; B65D 5/62; B65D 5/04; B65D 5/0254; B65D 5/0281; A47B 2200/0086; A47B 63/00; B42F 7/145
(Continued)

(56) References Cited

U.S. PATENT DOCUMENTS 2,182,858 A * 12/1939 Thompson ..... B42D 3/045 229/108
3,515,332 A * 6/1970 Irving ..... B65D 5/4254 229/149

(Continued)

FOREIGN PATENT DOCUMENTS

WO WO-2019230695 A1 * 12/2019 ..... B65D 5/62

*Primary Examiner* — Nathan J Newhouse
*Assistant Examiner* — Phillip D Schmidt
(74) *Attorney, Agent, or Firm* — McClure, Qualey & Rodack, LLP

(57) ABSTRACT

Assembling method of flattening-realizable file rack, comprising following steps: gluing; grey board pasting; folding; opening-burying; and forming. File rack assembled from the flattening-realizable file rack assembly method, comprises first single-powder cardboard body, wherein second single-powder cardboard body is formed at left side of the first single-powder cardboard body, third single-powder cardboard body is formed at right side of the first single-powder cardboard body, fifth single-powder cardboard body is vertically formed at top end of the first single-powder cardboard body, fourth single-powder cardboard body is formed at left side of the fifth single-powder cardboard body, and bottom end of the fourth single-powder cardboard body is connected with top end of the second single-powder cardboard body, sixth single-powder cardboard body is formed at right side of the fifth single-powder cardboard body, and bottom of the sixth single-powder cardboard body is connected with top end of the third single-powder cardboard body for forming.

4 Claims, 4 Drawing Sheets

(58) Field of Classification Search
USPC ..... 229/116.5, 122.32–122.34, 164.1, 919, 229/923, 108, 165.5, 116.1
See application file for complete search history.

(56) References Cited

U.S. PATENT DOCUMENTS

| | | | | |
|---|---|---|---|---|
| 3,829,005 | A * | 8/1974 | Hackenberg | B65D 5/10 229/132 |
| 2006/0060488 | A1* | 3/2006 | Rodriguez | B65D 51/245 206/457 |
| 2006/0102709 | A1* | 5/2006 | Smith | B42F 7/145 229/164 |
| 2006/0124711 | A1* | 6/2006 | Bowman | B65D 5/4262 229/116.5 |
| 2017/0129639 | A1* | 5/2017 | Carden | B65D 5/62 |

* cited by examiner

FLATTENING-REALIZABLE FILE RACK AND ASSEMBLING METHOD THEREOF

TECHNICAL FIELD

The present invention relates to the field of file racks, and more particularly, to a flattening-realizable file rack and an assembling method thereof.

BACKGROUND

At present, there are two main methods for flattening a file rack, wherein the first method is to print on powder gray paper, mount corrugated paperboards, mold and then bond with glue. This manufacturing process makes an interior of a file rack uneven, which affects the use and aesthetics of products; the other method is to wrap both-side grey (paperboard) with thin tissue paper (150 g), paste an inner liner, mold and then bond. This manufacturing process requires the thin tissue paper, which leads to easy damage of the tissue paper of the file folder. Secondly, a tongue print cannot be covered, so that the file rack does not look nice. For this purpose, a flattening-realizable file rack and an assembling method are provided.

SUMMARY

In order to overcome the above defects, the present invention aims at providing a technical solution capable of solving the above problems.

An assembling method of a flattening-realizable file rack comprises the following steps of:

S1. gluing: coating a glue on a first single-powder cardboard body, a second single-powder cardboard body, a third single-powder cardboard body, a fourth single-powder cardboard body, a fifth single-powder cardboard body, a sixth single-powder cardboard body, a seventh single-powder cardboard body and an eighth single-powder cardboard body respectively;

S2. grey board pasting: pasting the grey boards on surfaces of the first single-powder cardboard body, the second single-powder cardboard body, the third single-powder cardboard body and the eighth single-powder cardboard body coated with the glue in S1;

S3. folding: respectively folding a third connecting strip, a fourth connecting strip, the fourth single-powder cardboard body, the fifth single-powder cardboard body and the sixth single-powder cardboard body to form folded edges;

S4. opening-burying: performing opening-burying on a first connecting strip, a second connecting strip, a fifth connecting strip and the eighth single-powder cardboard body respectively; and S5. forming: folding, pasting and assembling a second connecting diaphragm, a first connecting paper lug, a second connecting paper lug, a first connecting diaphragm and a ninth single-powder cardboard body respectively, thereby forming the flattening-realizable file rack.

Preferably, the first single-powder cardboard body, the second single-powder cardboard body, the third single-powder cardboard body, the fourth single-powder cardboard body, the fifth single-powder cardboard body, the sixth single-powder cardboard body, the seventh single-powder cardboard body and the eighth single-powder cardboard body in S1 are respectively made of single-powder paper, and a weight of the single-powder paper is 350 g.

Preferably, the glue coated on the first single-powder cardboard body, the second single-powder cardboard body, the third single-powder cardboard body, the fourth single-powder cardboard body, the fifth single-powder cardboard body, the sixth single-powder cardboard body, the seventh single-powder cardboard body and the eighth single-powder cardboard body in S1 is a jelly glue.

Preferably, the grey boards used in S2 are both-side gray paperboards, and a total weight of the grey boards is 800 g.

A flattening-realizable file rack implemented according to the assembling method of the flattening-realizable file rack comprises a first single-powder cardboard body, wherein a second single-powder cardboard body is formed at a left side of the first single-powder cardboard body, and a fold is formed at a joint between the first single-powder cardboard body and the second single-powder cardboard body; a third single-powder cardboard body is formed at a right side of the first single-powder cardboard body, and a fold is formed at a joint between the first single-powder cardboard body and the third single-powder cardboard body; a fifth single-powder cardboard body is vertically formed at a top end of the first single-powder cardboard body, and a fold is formed at a joint between the fifth single-powder cardboard body and the first single-powder cardboard body; a fourth single-powder cardboard body is formed at a left side of the fifth single-powder cardboard body, a bottom end of the fourth single-powder cardboard body is connected with a top end of the second single-powder cardboard body for forming, and a fold is respectively formed at a joint between the fourth single-powder cardboard body and the second single-powder cardboard body as well as a joint between the fourth single-powder cardboard body and the fifth single-powder cardboard body; and a sixth single-powder cardboard body is formed at a right side of the fifth single-powder cardboard body, a bottom end of the sixth single-powder cardboard body is connected with a top end of the third single-powder cardboard body for forming, and a fold is respectively formed at a joint between the sixth single-powder cardboard body and the third single-powder cardboard body as well as a joint between the sixth single-powder cardboard body and the fifth single-powder cardboard body.

Preferably, a seventh single-powder cardboard body is formed at left side of the second single-powder cardboard body, and a fold is formed at a joint between the seventh single-powder cardboard body and the second single-powder cardboard body, and a first connecting paper lug is vertically formed at a bottom end of the seventh single-powder cardboard body; an eighth single-powder cardboard body is vertically formed at a top end of the seventh single-powder cardboard body, and a fold is formed at a joint between the seventh single-powder cardboard body and the eighth single-powder cardboard body; a ninth single-powder cardboard body is vertically formed at a top end of the eighth single-powder cardboard body, and a fold is formed at a joint between the eighth single-powder cardboard body and the ninth single-powder cardboard body; and a third connecting strip is obliquely formed at a left side of a top end of the second single-powder cardboard body, and a fold is formed at a joint between the third connecting strip and the second single-powder cardboard body.

Preferably, a fourth connecting strip is obliquely formed at a right side of the top end of the third single-powder cardboard body, and a fold is formed at a joint between the fourth connecting strip and the third single-powder cardboard body; and a fifth connecting strip is vertically formed at a right side of the third single-powder cardboard body, and a fold is formed at a joint between the fifth connecting strip and the third single-powder cardboard body.

Preferably, a first connecting strip is vertically formed at a left side of the fourth single-powder cardboard body, and a fold is formed at a joint between the first connecting strip and the fourth single-powder cardboard body.

Preferably, a second connecting strip is vertically formed at a right side of the sixth single-powder cardboard body, and a fold is formed at a joint between the second connecting strip and the sixth single-powder cardboard body.

Preferably, both-side grey boards are respectively attached on surfaces of the first single-powder cardboard body, the second single-powder cardboard body and the third single-powder cardboard body, and the fifth single-powder cardboard body, the fourth single-powder cardboard body and the sixth single-powder cardboard body are respectively pasted on surfaces of the both-side grey boards; a second connecting paper lug is vertically formed at a bottom end of the first single-powder cardboard body, and a fold is formed at a joint between the second connecting paper lug and the first single-powder cardboard body; a first connecting diaphragm is horizontally formed at a bottom end of the second single-powder cardboard body, and a fold is formed at a joint between the first connecting diaphragm and the second single-powder cardboard body; and a second connecting diaphragm is horizontally formed at a bottom end of the third single-powder cardboard body, a fold is formed at a joint between the second connecting diaphragm and the third single-powder cardboard body, and a square hole is horizontally formed at a middle position in a surface of the second connecting diaphragm.

Compared with the prior art, the present invention has the beneficial effects that: the tissue paper is not limited to the thin paper, and the tissue paper of the file rack is not easy to damage, has no tongue prints, and is simple to assemble in one step. Moreover, the assembled file rack looks beautiful and simple.

Part of the additional aspects and advantages of the present invention will be given in part in the following description, and will become apparent in part from the following description, or will be learned through the practice of the present invention.

BRIEF DESCRIPTION OF THE DRAWINGS

In order to illustrate the technical solutions in the embodiments of the present invention or in the related art more clearly, the drawings used in the description of the embodiments or the prior art will be briefly described below. Obviously, the drawings in the following description are merely some embodiments of the present invention. Those of ordinary skills in the art can also obtain other drawings based on these drawings without going through any creative work.

Figure 1:
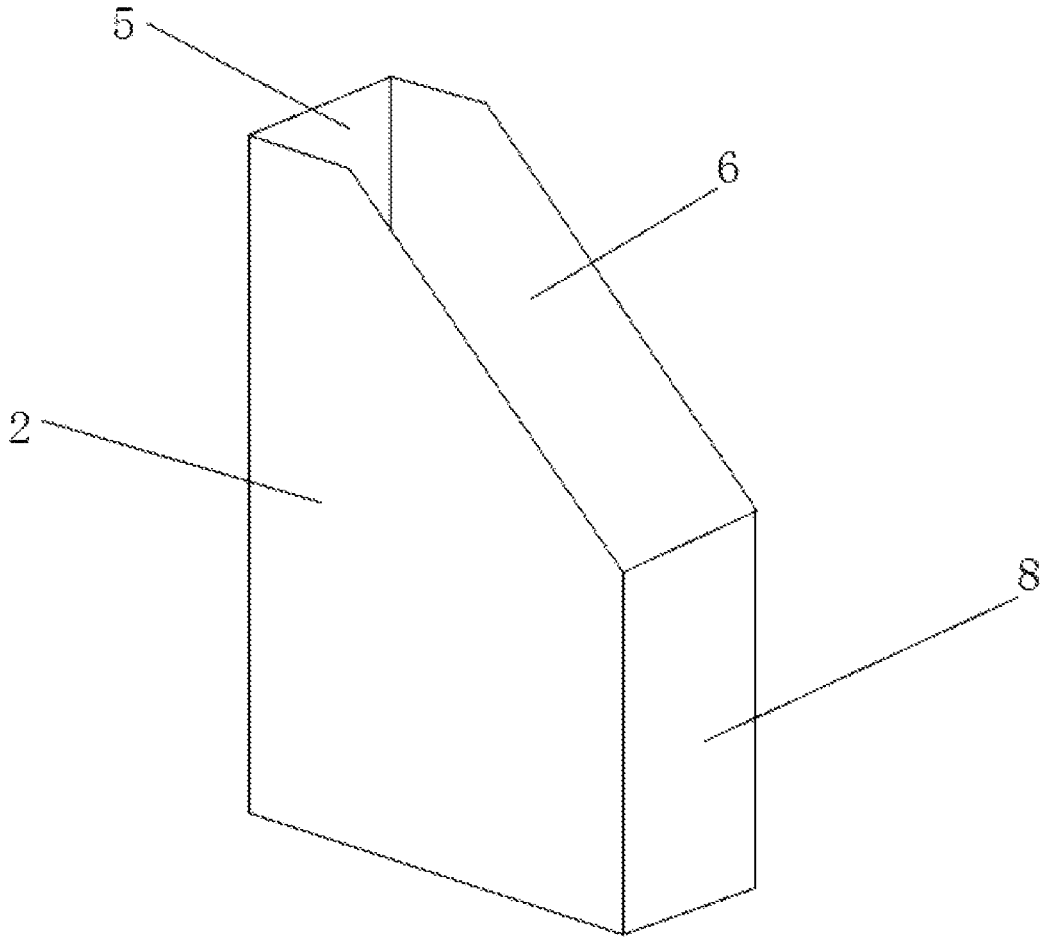
FIG. 1 is a structural schematic diagram of a flattening-realizable file rack.

In the drawings: 1 refers to first single-powder cardboard body, 2 refers to second single-powder cardboard body, 3 refers to third single-powder cardboard body, 4 refers to fourth single-powder cardboard body, 5 refers to fifth single-powder cardboard body, 6 refers to sixth single-powder cardboard body, 7 refers to seventh single-powder cardboard body, 8 refers to eighth single-powder cardboard body, 9 refers to ninth single-powder cardboard body, 11 refers to first connecting strip, 12 refers to second connecting strip, 13 refers to third connecting strip, 14 refers to fourth connecting strip, 15 refers to fifth connecting strip, 16 refers to first connecting paper lug, 17 refers to first connecting diaphragm, 18 refers to second connecting paper lug, 19 refers to second connecting diaphragm, 20 refers to square hole, and 21 refers to both-side grey board.

DETAILED DESCRIPTION

The following clearly and completely describes the technical solutions in the embodiments of the present invention with reference to the accompanying drawings in the embodiments of the present invention. Apparently, the described embodiments are merely some but not all of the embodiments of the present invention. Based on the embodiments of the present invention, all other embodiments obtained by those of ordinary skills in the art without going through any creative work shall fall within the scope of protection of the present invention.

First Embodiment

An assembling method of a flattening-realizable file rack comprises the following steps of:

S1. gluing: coating a glue on a first single-powder cardboard body 1, a second single-powder cardboard body 2, a third single-powder cardboard body 3, a fourth single-powder cardboard body 4, a fifth single-powder cardboard body 5, a sixth single-powder cardboard body 6, a seventh single-powder cardboard body 7 and an eighth single-powder cardboard body 8 respectively;

S2. grey board pasting: pasting the grey boards on surfaces of the first single-powder cardboard body 1, the second single-powder cardboard body 2, the third single-powder cardboard body 3 and the eighth single-powder cardboard body 8 coated with the glue in S1;

S3. folding: respectively folding a third connecting strip 13, a fourth connecting strip 14, the fourth single-powder cardboard body 4, the fifth single-powder cardboard body 5 and the sixth single-powder cardboard body 6 to form folded edges;

S4. opening-burying: performing opening-burying on a first connecting strip 11, a second connecting strip 12, a fifth connecting strip 15 and the eighth single-powder cardboard body 8 respectively; and S5. forming: folding, pasting and assembling a second connecting diaphragm 19, a first connecting paper lug 16, a second connecting paper lug 18, a first connecting diaphragm 17 and a ninth single-powder cardboard body 9 respectively, thereby forming the flattening-realizable file rack.

The first single-powder cardboard body 1, the second single-powder cardboard body 2, the third single-powder cardboard body 3 and the eighth single-powder cardboard body 8 in S1 are respectively made of single-powder paper, and a weight of the single-powder paper is 350 g.

The glue coated on the first single-powder cardboard body 1, the second single-powder cardboard body 2, the third single-powder cardboard body 3 and the eighth single-powder cardboard body 8 in S1 is a jelly glue.

The grey boards used in S2 are both-side gray paperboards, and a total weight of the grey boards is 800 g.

Second Embodiment

Figure 2:
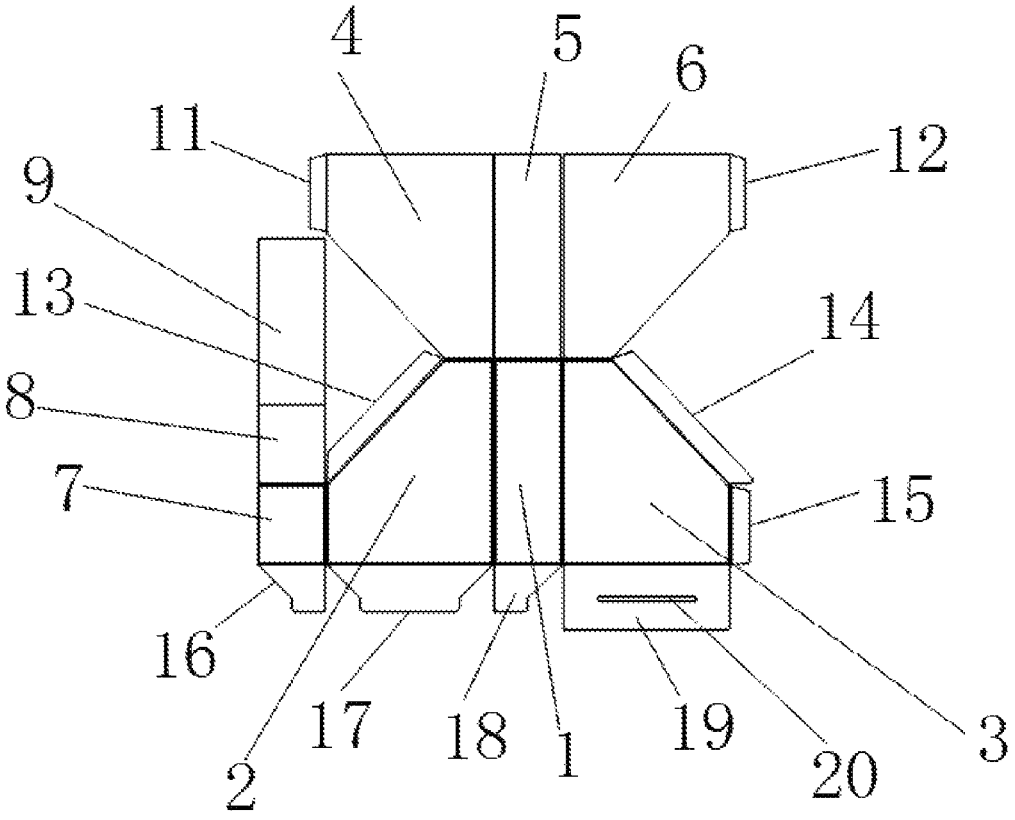
FIG. 2 is a schematic diagram of an open structure of the flattening-realizable file rack.
Figure 3:
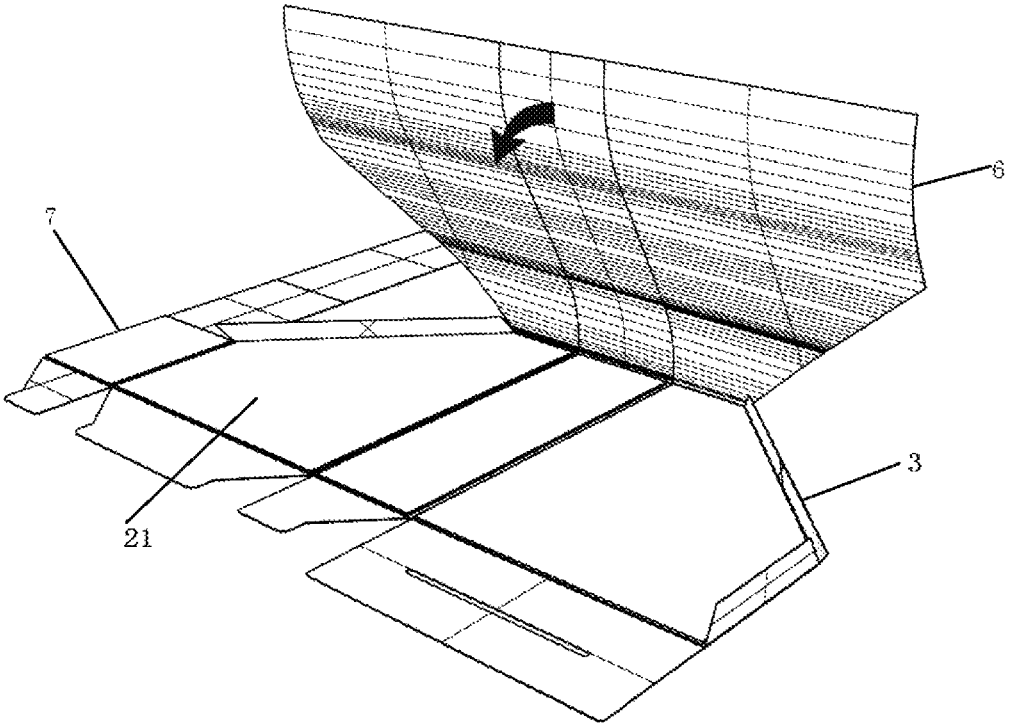
FIG. 3 is another structural schematic diagram of the flattening-realizable file rack.
Figure 4:
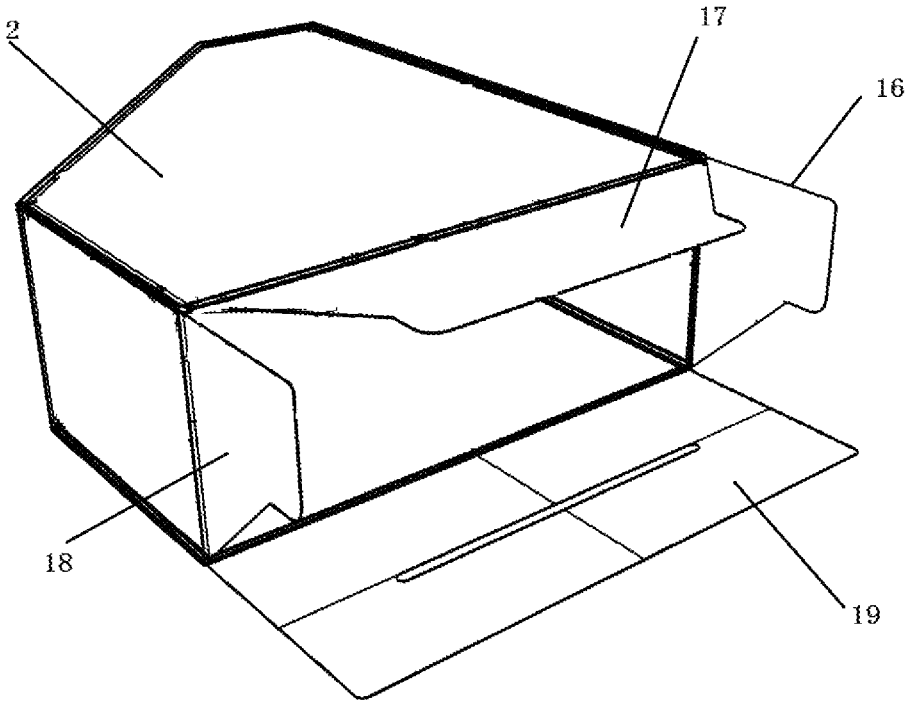
FIG. 4 is still another structural schematic diagram of the flattening-realizable file rack.
Figure 5:
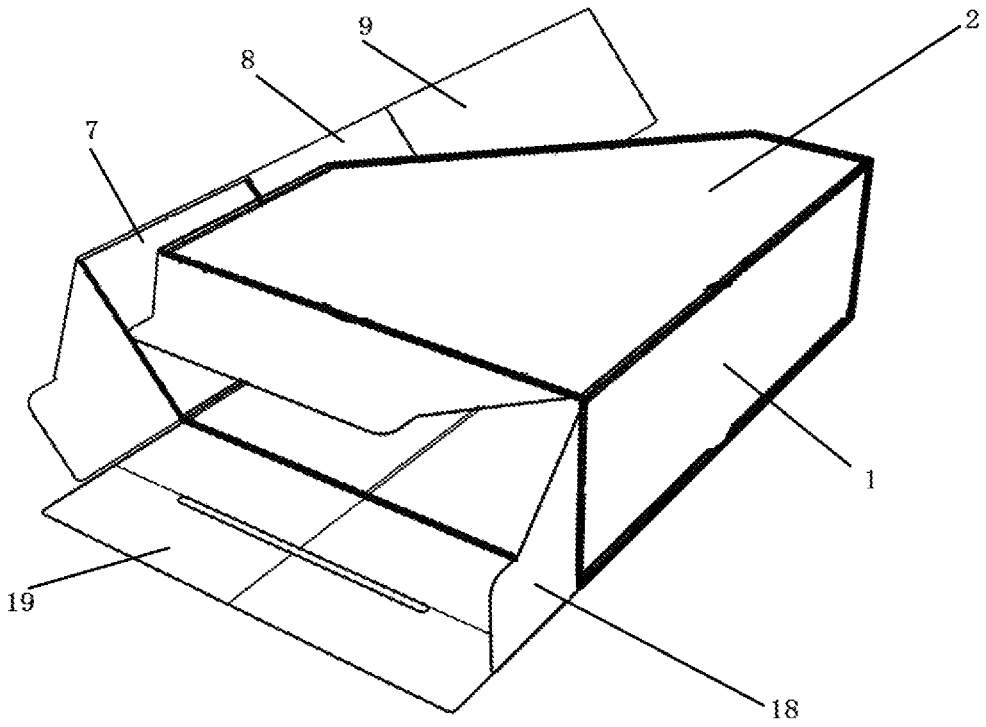
FIG. 5 is an assembly diagram of the flattening-realizable file rack.

Referring to FIGS. 1 to 5, a flattening-realizable file rack implemented according to the assembling method of the flattening-realizable file rack comprises a first single-powder cardboard body 1, wherein a second single-powder cardboard body 2 is formed at a left side of the first single-powder cardboard body 1, a fold is formed at a joint between the first single-powder cardboard body 1 and the second single-powder cardboard body 2, and the second single-powder cardboard body 2 is folded at the left side of the first single-powder cardboard body 1 through the fold; a third single-powder cardboard body 3 is formed at a right side of the first single-powder cardboard body 1, a fold is formed at a joint between the first single-powder cardboard body 1 and the third single-powder cardboard body 3, and the third single-powder cardboard body 3 is folded at the right side of the first single-powder cardboard body 1 through the fold; a fifth single-powder cardboard body 5 is vertically formed at a top end of the first single-powder cardboard body 1, a fold is formed at a joint between the fifth single-powder cardboard body 5 and the first single-powder cardboard body 1, and the fifth single-powder cardboard body 5 is folded on the first single-powder cardboard body 1 through the fold; a fourth single-powder cardboard body 4 is formed at a left side of the fifth single-powder cardboard body 5, a bottom end of the fourth single-powder cardboard body 4 is connected with a top end of the second single-powder cardboard body 2 for forming, and a fold is respectively formed at a joint between the fourth single-powder cardboard body 4 and the second single-powder cardboard body 2 as well as a joint between the fourth single-powder cardboard body 4 and the fifth single-powder cardboard body 5; and a sixth single-powder cardboard body 6 is formed at a right side of the fifth single-powder cardboard body 5, a bottom end of the sixth single-powder cardboard body 6 is connected with a top end of the third single-powder cardboard body 3 for forming, and a fold is respectively formed at a joint between the sixth single-powder cardboard body 6 and the third single-powder cardboard body 3 as well as a joint between the sixth single-powder cardboard body 6 and the fifth single-powder cardboard body 5, so that the fifth single-powder cardboard body 5, the fourth single-powder cardboard body 4 and the sixth single-powder cardboard body 6 are folded through the folds and pasted onto the first single-powder cardboard body, 1 the second single-powder cardboard body 2 and the third single-powder cardboard body 3, thus forming a semi-finished file rack.

A seventh single-powder cardboard body 7 is formed at a left side of the second single-powder cardboard body 2, a fold is formed at a joint between the seventh single-powder cardboard body 7 and the second single-powder cardboard body 2, and a first connecting paper lug 16 is vertically formed at a bottom end of the seventh single-powder cardboard body 7, so that the seventh single-powder cardboard body 7 is folded at the left side of the second single-powder cardboard body 2 through the fold, and the first connecting paper lug 16 is folded at a bottom end of the second single-powder cardboard body 2 through the fold. An eighth single-powder cardboard body 8 is vertically formed at a top end of the seventh single-powder cardboard body 7, a fold is formed at a joint between the seventh single-powder cardboard body 7 and the eighth single-powder cardboard body 8, and the eighth single-powder cardboard body is folded at the top end of the seventh single-powder cardboard body 7 through the fold. A ninth single-powder cardboard body is vertically formed at a top end of the eighth single-powder cardboard body 8, a fold is formed at a joint between the eighth single-powder cardboard body 8 and the ninth single-powder cardboard body 9, and the ninth single-powder cardboard body 9 is folded at the top end of the eighth single-powder cardboard body 8 through the fold, so as to be folded in an interior of the file rack, thus forming a semi-finished internal substrate of the file rack.

A third connecting strip 13 is obliquely formed at a left side of a top end of the second single-powder cardboard body 2, a fold is formed at a joint between the third connecting strip 13 and the second single-powder cardboard body 2, and the third connecting strip 13 is folded at the left side of the top end of the second single-powder cardboard body 2 through the fold and pasted onto a surface of the second single-powder cardboard body 2.

A fourth connecting strip 14 is obliquely formed at a right side of the top end of the third single-powder cardboard body 3, and a fold is formed at a joint between the fourth connecting strip 14 and the third single-powder cardboard body 3; and a fifth connecting strip 15 is vertically formed at a right side of the third single-powder cardboard body 3, and a fold is formed at a joint between the fifth connecting strip 15 and the third single-powder cardboard body 3, so that the fourth connecting strip 14 is folded at the right side of the top end of the third single-powder cardboard body 3 through the fold and pasted on a surface of the third single-powder cardboard body 3, and the fifth connecting strip 15 is folded at the right side of the third single-powder cardboard body 3 through the fold.

A first connecting strip 11 is vertically formed at a left side of the fourth single-powder cardboard body 4, a fold is formed at a joint between the first connecting strip 11 and the fourth single-powder cardboard body 4, and the first connecting strip the fourth single-powder cardboard body 11 is folded at the left side of the fourth single-powder cardboard body 4 through the fold.

A second connecting strip 12 is vertically formed at a right side of the sixth single-powder cardboard body 6, a fold is formed at a joint between the second connecting strip 12 and the sixth single-powder cardboard body 6, and the second connecting strip 12 is folded at the left side of the sixth single-powder cardboard body 6 through the fold.

Both-side grey boards 21 are respectively attached on surfaces of the first single-powder cardboard body 1, the second single-powder cardboard body 2 and the third single-powder cardboard body 3, and the fifth single-powder cardboard body 5, the fourth single-powder cardboard body 4 and the sixth single-powder cardboard body 6 are respectively pasted on surfaces of the both-side grey boards 21, so that the both-side grey boards 21 are wrapped among the fifth single-powder cardboard body 5, the fourth single-powder cardboard body 4 and the sixth single-powder cardboard body 6 as well as wrapped among the first single-powder cardboard body 1, the second single-powder cardboard body 2 and the third single-powder cardboard body 3, and the second single-powder cardboard body 2 and the third single-powder cardboard body 3 are respectively pasted and connected with the fourth single-powder cardboard body 4 and the sixth single-powder cardboard body 6 through the third connecting strip 13 and the fourth connecting strip 14, such that the third single-powder cardboard body 3 is pasted and connected with the seventh single-powder cardboard body 7 through a pasting strip formed by pasting the second connecting strip 12 on a surface of the fifth connecting strip 15 and the first connecting strip 11, thus forming the file rack.

A second connecting paper lug 18 is vertically formed at a bottom end of the first single-powder cardboard body 1, a fold is formed at a joint between the second connecting paper lug 18 and the first single-powder cardboard body 1, and the second connecting paper lug 18 is folded at a bottom end of the first single-powder cardboard body 1 through the fold; a first connecting diaphragm 17 is horizontally formed at a bottom end of the second single-powder cardboard body 2, a fold is formed at a joint between the first connecting diaphragm 17 and the second single-powder cardboard body 2, and the first connecting diaphragm 17 is folded at a bottom end of the second single-powder cardboard body 2 through the fold; a second connecting diaphragm 19 is horizontally formed at a bottom end of the third single-powder cardboard body 3, a fold is formed at a joint between the second connecting diaphragm 19 and the third single-powder cardboard body 3, a square hole 20 is horizontally formed at a middle position in a surface of the second connecting diaphragm 19, and the second connecting diaphragm 19 is folded at the bottom end of the second single-powder cardboard body 2 through the fold; when the third single-powder cardboard body 3 is pasted and connected with the seventh single-powder cardboard body 7 through the pasting strip formed by pasting the second connecting strip 12 on the surface of the fifth connecting strip 15 and the first connecting strip 11, the second connecting diaphragm 19 is folded; moreover, the first connecting paper lug 16 and the second connecting paper lug 18 are folded, covered and pasted on left and right sides of a bottom surface of the second connecting diaphragm 19, and the first connecting diaphragm 17 is pasted on the bottom surface of the second connecting diaphragm 19 and passes through the square hole 20, thus forming a substrate of the file rack.

It is apparent to those skilled in the art that the present invention is not limited to the details of the above-mentioned exemplary embodiments, and can be implemented in other specific forms without departing from the spirit or basic features of the present invention. Therefore, the embodiments should be regarded as exemplary and non-limiting from any point of view, and the scope of the present invention is defined by the appended claims instead of the above description, so it is intended to embrace all changes falling within the meaning and scope of equivalent elements of the claims.

The invention claimed is:

1. A flattening-realizable file rack obtained by the following steps:

(S1) gluing: coating a glue on a first one side coated board body, a second one side coated board body, a third one side coated board body, a fourth one side coated board body, a fifth one side coated board body, a sixth one side coated board body, a seventh one side coated board body and an eighth one side coated board body respectively;

(S2) grey board pasting: pasting grey boards on surfaces of the first one side coated board body, the second one side coated board body, the third one side coated board body and the eighth one side coated board body coated with the glue;

(S3) folding: respectively folding a third connecting strip, a fourth connecting strip, the fourth one side coated board body, the fifth one side coated board body and the sixth one side coated board body to form folded edges;

(S4) folding: folding a first connecting strip, a second connecting strip, a fifth connecting strip and the eighth one side coated board body respectively; and (S5) forming: folding, pasting and assembling a second connecting diaphragm, a first connecting paper lug, a second connecting paper lug, a first connecting diaphragm and a ninth one side coated board body respectively, thereby forming the flattening-realizable file rack, wherein the flattening-realizable file rack comprises the first one side coated board body, wherein the second one side coated board body is formed at a left side of the first one side coated board body, and a fold is formed at a joint between the first one side coated board body and the second one side coated board body; the third one side coated board body is formed at a right side of the first one side coated board body, and a fold is formed at a joint between the first one side coated board body and the third one side coated board body; the fifth one side coated board body is vertically formed at a top end of the first one side coated board body, and a fold is formed at a joint between the fifth one side coated board body and the first one side coated board body; the fourth one side coated board body is formed at a left side of the fifth one side coated board body, a bottom end of the fourth one side coated board body is connected with a top end of the second one side coated board body for forming, and a fold is respectively formed at a joint between the fourth one side coated board body and the second one side coated board body as well as a joint between the fourth one side coated board body and the fifth one side coated board body; and the sixth one side coated board body is formed at a right side of the fifth one side coated board body, a bottom end of the sixth one side coated board body is connected with a top end of the third one side coated board body for forming, and a fold is respectively formed at a joint between the sixth one side coated board body and the third one side coated board body as well as a joint between the sixth one side coated board body and the fifth one side coated board body;

wherein the seventh one side coated board body is formed at left side of the second one side coated board body, and a fold is formed at a joint between the seventh one side coated board body and the second one side coated board body, and a first connecting paper lug is vertically formed at a bottom end of the seventh one side coated board body; the eighth one side coated board body is vertically formed at a top end of the seventh one side coated board body, and a fold is formed at a joint between the seventh one side coated board body and the eighth one side coated board body; a ninth one side coated board body is vertically formed at a top end of the eighth one side coated board body, and a fold is formed at a joint between the eighth one side coated board body and the ninth one side coated board body; and the third connecting strip is obliquely formed at a left side of a top end of the second one side coated board body, and a fold is formed at a joint between the third connecting strip and the second one side coated board body.

2. The flattening-realizable file rack according to claim 1, wherein the fourth connecting strip is obliquely formed at a right side of the top end of the third one side coated board body, and a fold is formed at a joint between the fourth connecting strip and the third one side coated board body; and a fifth connecting strip is vertically formed at a right side of the third one side coated board body, and a fold is formed at a joint between the fifth connecting strip and the third one side coated board body.

3. The flattening-realizable file rack according to claim 1, wherein the first connecting strip is vertically formed at a left side of the fourth one side coated board body, and a fold is formed at a joint between the first connecting strip and the fourth one side coated board body.

4. The flattening-realizable file rack according to claim 1, wherein the second connecting strip is vertically formed at a right side of the sixth one side coated board body, and a fold is formed at a joint between the second connecting strip and the sixth one side coated board body.

* * * * *